US009140093B2

(12) United States Patent
Ford et al.

(10) Patent No.: US 9,140,093 B2
(45) Date of Patent: Sep. 22, 2015

(54) APPARATUS AND METHODS FOR RESTRICTING FLOW IN A BORE

(71) Applicant: Weatherford/Lamb, Inc., Houston, TX (US)

(72) Inventors: Daniel Ford, Norfolk (GB); James Fogg, Norfolk (GB)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 13/866,650

(22) Filed: Apr. 19, 2013

(65) Prior Publication Data

US 2013/0228342 A1 Sep. 5, 2013

Related U.S. Application Data

(63) Continuation of application No. PCT/GB2011/001508, filed on Oct. 20, 2011.

(30) Foreign Application Priority Data

Oct. 22, 2010 (GB) ..... 1017914.1

(51) Int. Cl.

| | |
|---|---|
| ***E21B 33/06*** | (2006.01) |
| ***E21B 34/06*** | (2006.01) |
| ***E21B 34/02*** | (2006.01) |
| *E21B 34/10* | (2006.01) |

(52) U.S. Cl.

CPC ..... *E21B 33/062* (2013.01); *E21B 34/06* (2013.01); *E21B 34/02* (2013.01); *E21B 34/10* (2013.01)

(58) Field of Classification Search

CPC ..... E21B 34/02; E21B 34/06; E21B 34/10

USPC ..... 166/373, 316, 319, 75.15

See application file for complete search history.

(56) References Cited

U.S. PATENT DOCUMENTS

| | | | | |
|---|---|---|---|---|
| 2,293,153 | A | 8/1942 | Lorehn et al. | |
| 4,360,064 | A * | 11/1982 | O'Connor et al. | 166/319 |
| 4,712,619 | A * | 12/1987 | Stepp et al. | 166/327 |
| 4,809,733 | A | 3/1989 | Hawkins | |
| 5,819,853 | A * | 10/1998 | Patel | 166/373 |
| 6,024,172 | A | 2/2000 | Lee | |
| 7,451,809 | B2 * | 11/2008 | Noske et al. | 166/66 |
| 8,453,749 | B2 * | 6/2013 | Vick et al. | 166/374 |
| 2008/0099701 | A1 | 5/2008 | Whitby et al. | |

OTHER PUBLICATIONS

Dictionary definition of "gate valve", accessed via thefreedictionary.com on Sep 11, 2013.*

Dictionary definition of "proximal", accessed Jun. 11, 2014 via thefreedictionary.com.*

International Search Report and Written Opinion for PCT Application No. PCT/GB2011/001508 dated Mar. 7, 2013.

* cited by examiner

*Primary Examiner* — Blake Michener

(74) *Attorney, Agent, or Firm* — Blank Rome LLP

(57) ABSTRACT

Apparatus (10) for restricting a flow of fluid through a bore (14) comprises a bore sealing member (12*a*) and an actuation assembly for moving the bore sealing member (12*a*) between first and second configurations. The actuation assembly is configured to isolate first and second end portions (46, 48) of the activation member (12*a*) from a bore fluid (50). The apparatus (10) provides for moving the bore sealing member (12*a*) between the first and second configurations without a bore fluid (50) pressure acting on an end portion (46, 48) of the activation member (12*a*).

27 Claims, 5 Drawing Sheets

PRIOR ART

APPARATUS AND METHODS FOR RESTRICTING FLOW IN A BORE

CROSS-REFERENCE TO RELATED APPLICATION

This application claims the benefit of PCT Application PCT/GB2011/001508 filed Oct. 20, 2011, which claims priority to Great Britain application 1017914.1 filed Oct. 20, 2010, each of which are incorporated by reference in their entirety.

BACKGROUND

Wellbores for accessing oil and gas reserves are typically provided with one or more valves or pairs of valves for restricting the wellbore. These valves are used to resist the flow of fluids in the bore and may ultimately be used to close the wellbore, such as BOPs. The valves are used to prevent undesirable exposure of pressurised fluids during the drilling or operation of a well. For example, in a downhole intervention operation, wireline valves allow the well operator to insert and remove tools deployed on coiled tubing or wireline within a wellbore while maintaining pressure in the well.

Wireline valves are intended to stop the flow of a fluid through a tubular or to seal an annular space between two tubulars. Different types of wireline valves, such as annular or blind, are available. For example, blind valves crush or shear tubulars then seal the wellbore.

The valve often comprises a pair of seals that are pressed against each other to prevent fluid flowing through the bore. A valve sometimes has a cutter for shearing equipment such as piping or wireline that may be located in the bore to allow the valve to close to seal off the wellbore.

Wireline valves generally require movement of parts into a pressurised fluid in the wellbore. The valves are usually hydraulically activated, although some valves are mechanically activated.

In order to seal the bore, valve actuators must move parts that are exposed to the wellbore fluid pressure. Fluid pressure in wells can easily exceed 50 MPa and the resultant forces on parts of the valve are typically several tons.

SUMMARY

According to an aspect of the invention there is provided an apparatus for restricting a flow of fluid through a bore, the apparatus comprising:

a bore sealing member; and an actuation assembly for moving the bore sealing member between a first configuration and a second configuration, the actuation assembly comprising an activation member with a first end portion and a second end portion, wherein the actuation assembly is configured to isolate the first and second end portions of the activation member from a bore fluid.

Isolating the first end portion and the second end portion of the activation member from a bore fluid enables the activation member to move between a first position corresponding to the first configuration and a second position corresponding the second configuration, without pressure associated with a bore fluid acting on an end portion of the activation member; such as to resist movement of the activation member between the first position and the second position.

The first configuration may be a wellbore open configuration.

The second configuration may be a wellbore closed configuration.

The apparatus may be configured to displace substantially the same volume of fluid in the first configuration and in the second configuration. The total volume of fluid displaced by the apparatus may be the same in the first configuration and in the second configuration. The displaced volume of fluid may be a static volume of fluid. Movement of the apparatus between the first and second configurations may not affect the displaced volume of fluid. Maintaining the same volume of fluid displaced by the apparatus in the first configuration and in the second configuration ensures that force is not required to displace additional fluid when the apparatus is moved between the first and second configurations.

Alternatively, the apparatus may be configured to displace a different volume of fluid in the second configuration than in the first configuration. For example, the apparatus may be configured to displace a greater volume of fluid in the second configuration. Displacing a greater volume of fluid in the second configuration may bias the apparatus towards the first configuration. Alternatively, the apparatus may be configured to displace a greater volume of fluid in the first configuration; for example to bias the apparatus towards the second configuration.

The apparatus may be biased towards the first configuration. Alternatively, the apparatus may be biased towards the second configuration.

The apparatus may be configured to occupy substantially the same volume within a wellbore fluid envelope in the first configuration and in the second configuration.

The first end portion of the activation member may be configured to be proximal to the bore in the first configuration and the second end portion of the activation member may be configured to be distal to the bore in the first configuration.

The actuation assembly may be configured to move the activation member in a direction substantially perpendicular to the bore.

The actuation assembly may further comprise an isolator comprising a first side configured for receiving the first end portion of the activation member. The actuation assembly may be configured to define an isolation chamber between the first end portion of the activation member and a portion of the isolator.

The actuation assembly may be configured to separate the isolator first side from the bore fluid and to position an isolator second side in fluid communication with the bore fluid. The isolator may be configured to form a boundary between a first portion of the apparatus and a second portion of the apparatus, the first portion of the apparatus configured to be exposed to wellbore fluid pressure and the second portion of the apparatus configured to be exposed to a second fluid pressure. The second fluid pressure may be lower than the wellbore fluid pressure, for example the second fluid pressure may be atmospheric.

The actuation assembly may further comprise a first end portion seal, the first end portion seal configured to prevent the first end portion contacting the bore fluid. For example, to prevent bore fluid entering the isolation chamber.

The first end portion seal may be an annular seal between the activation member and the isolator.

The first end portion and the second end portion of the activation member may be configured to be in fluid communication. For example, the first end portion of the activation member may be linked to the second end portion of the activation member via a fluid passage, such as a conduit. Alternatively, the first end portion and the second end portion may be isolated such that the first end portion and second end portions may be subjected to different fluid pressures.

The isolator may be configured to accommodate a stroke of the activation member. For example, the isolator may be a cylinder.

The activation member may be a piston.

The isolator may be configured to maintain substantially the same position relative to the bore during movement of the activation member from the first position to the second position. For example the isolator may be fixed.

The activation member may further comprise a bore sealing member interface. The bore sealing member interface may be located between the first end portion and the second end portion of the activation member.

The activation member may comprise a central portion located between the first and second end portions. The central portion may be configured to be in fluid communication with the bore fluid. Alternatively, the central portion may be configured to be isolated from the bore fluid.

The actuation assembly may further comprise an activation member housing configured for receiving the central portion.

The isolator may be attached to the activation member housing. For example, the activation member housing may comprise the isolator.

The isolator may be configured to control the bore fluid pressure acting axially on the activation member.

The activation member housing may comprise a first portion and a second portion, the first portion configured to be in fluid communication with the bore fluid and the second portion configured to be isolated from the bore fluid.

The actuation assembly may further comprise a proximal chamber, the proximal chamber located between the isolator and the activation member housing. The actuation assembly may be configured to enable fluid communication between the proximal chamber and the bore. Additionally or alternatively, the actuation assembly may be configured to isolate the proximal chamber from fluid in the bore.

The actuation assembly may further comprise an intermediate chamber. The intermediate chamber may be separated from the proximal chamber by the activation member housing. The intermediate chamber may be located between the proximal chamber and the second end portion of the activation member.

The actuation assembly may further comprise a second end portion seal. The second end portion seal may be configured to prevent the second end portion contacting the bore fluid. For example, the intermediate chamber may be fluidly isolated from the proximal chamber.

The first end portion seal may be configured to seal a first cross-sectional area of the activation member perpendicular to the direction of extension. The second end portion seal may be configured to seal a second cross-sectional area of the activation member perpendicular to the direction of extension. The first and the second cross-sectional areas may be substantially the same. Alternatively, the second cross-sectional area may be greater than the first cross-sectional area. For example, the second end portion seal may comprise an opening for receiving a larger activation member diameter than an opening of the first end portion seal. Alternatively, the first cross-sectional area may be greater than the second cross-sectional area.

The first and second cross-sectional areas may be selected according to a wellbore fluid characteristic/s and/or a wellbore characteristic/s and/or a desired force/s required to move the bore sealing member between the first and second configurations. For example, where the second end portion seal diameter is greater than a first end portion seal diameter, the difference between the diameters may be less for a larger fluid pressure.

The second end portion seal may be an annular seal between the central portion and the activation member housing.

The activation member may be configured to move axially within the activation member housing.

The actuation assembly may further comprise an activation member housing seal between the intermediate chamber and the proximal chamber.

The actuation assembly may be housed in an actuation assembly casing. The activation member housing seal may be located between the activation member housing and the casing.

The intermediate chamber may be in fluid communication with the isolation chamber. For example, the second intermediate chamber may be connected to the isolation chamber via a fluid conduit.

The isolation chamber may be in atmospheric fluid communication. For example, the isolation chamber may be fluidly connected, such as via a venting conduit, to outside of the apparatus. The activation member may comprise at least a portion of the venting conduit. For example, the activation member may comprise an axial passage.

The actuation assembly may further comprise a distal chamber. The distal chamber may be located between the intermediate chamber and the second end portion.

The apparatus may be configured to be hydraulically activated. For example, the distal chamber may be may be an activation chamber configured to be in fluid communication with a hydraulic source. Additionally, or alternatively, the apparatus may comprise a mechanical actuator. For example, the distal chamber may comprise a first threaded member. The first threaded member may be configured to receive a second threaded member.

The mechanical actuator may be configured to maintain the bore sealing member in the second configuration. For example, the mechanical actuator may be a manual lock.

The first threaded member may be configured to be located at a fixed distance from the bore. The first threaded member may be configured to rotate about a rotation axis substantially perpend portionicular to the bore.

Axial movement of the first threaded member with respect to the second threaded member may be restricted, such that rotational movement of the first threaded member with respect to the second threaded member results in axial movement of the first threaded member with respect to the second threaded member.

The second threaded member may be configured to move the activation member. For example a proximal end portion of the second threaded member may contact a portion of the activation member proximal to the second end portion of the activation member.

The apparatus may be configured to define the rotational movement of the activation member about an axis parallel to the direction of extension of the activation member. The actuation assembly may be configured to prevent rotation of the activation member about the axis parallel to the direction of extension of the activation member. For example, the activation member may comprise a linear element. The linear element may be a slot. Additionally, or alternatively the linear element may be a radial protrusion.

The bore sealing member interface may be configured to connect the central portion to a bore sealing member support.

The bore sealing member support may be configured to move coaxially with the activation member. The bore sealing member support may be configured to move simultaneously with the activation member.

The bore sealing member interface may be configured to restrict movement of the bore sealing member support relative to the activation member. For example, the bore sealing member interface may be configured to restrict rotation of the bore sealing member support. Additionally, or alternatively, the bore sealing member interface.

At least a portion of the bore sealing member support may be configured to substantially surround the isolator. For example, the bore sealing member support may be a sleeve.

The bore sealing member support may be configured to define the rotational movement of the bore seal about the axis parallel to the direction of extension of the activation member. The bore sealing member support may be configured to prevent rotation of the bore seal about an axis parallel to the direction of extension of the activation member. For example, the bore sealing member may comprise a profiled portion, the profiled portion configured to restrict circumferential movement of the bore sealing member.

The apparatus may further comprise a locking member. The locking member may be configured to maintain the bore sealing member in the second configuration. For example, the locking member may be configured to engage the activation member in the second position such that axial movement of the activation member is restricted.

The apparatus may comprise a wireline valve.

The apparatus may comprise a BOP.

The apparatus may comprise a gate valve.

The apparatus may be configured to expose only an intermediate portion of the activation member to the bore fluid pressure, the intermediate portion located between the first and second end portions.

According to an aspect of the invention there is provided a method of restricting fluid flow in a bore, the method comprising:

moving a bore sealing member from a first configuration to a second configuration by moving an activation member from a first position to a second position, the activation member comprising a first end portion and a second end portion, wherein the activation member is moved from the first position to the second position with the first end portion and the second end portion isolated from a bore fluid.

According to an aspect of the invention, there is provided an apparatus for restricting a flow of fluid through a bore, the apparatus comprising:

a bore sealing member; and an actuation assembly;

wherein the bore sealing member is connected to the actuation assembly by a profiled head, the profiled head being rotationally asymmetrical about a central longitudinal axis of the bore sealing member.

Providing such a profiled head prevents rotation of the bore sealing member about its longitudinal axis such that an orientation of the bore sealing member may be maintained, such as an upright orientation relative to a wellbore.

The invention includes one or more corresponding aspects, embodiments or features in isolation or in various combinations whether or not specifically stated (including claimed) in that combination or in isolation. For example, it will readily be appreciated that features recited as optional with respect to one aspect may be additionally applicable with respect to any of the other aspects, without the need to explicitly and unnecessarily list those various combinations and permutations here.

The above summary is intended to be merely exemplary and non-limiting.

BRIEF DESCRIPTION

These and other aspects of the present invention will now be described, by way of example, with reference to the accompanying drawings, in which.

DETAILED DESCRIPTION

Figure 1:
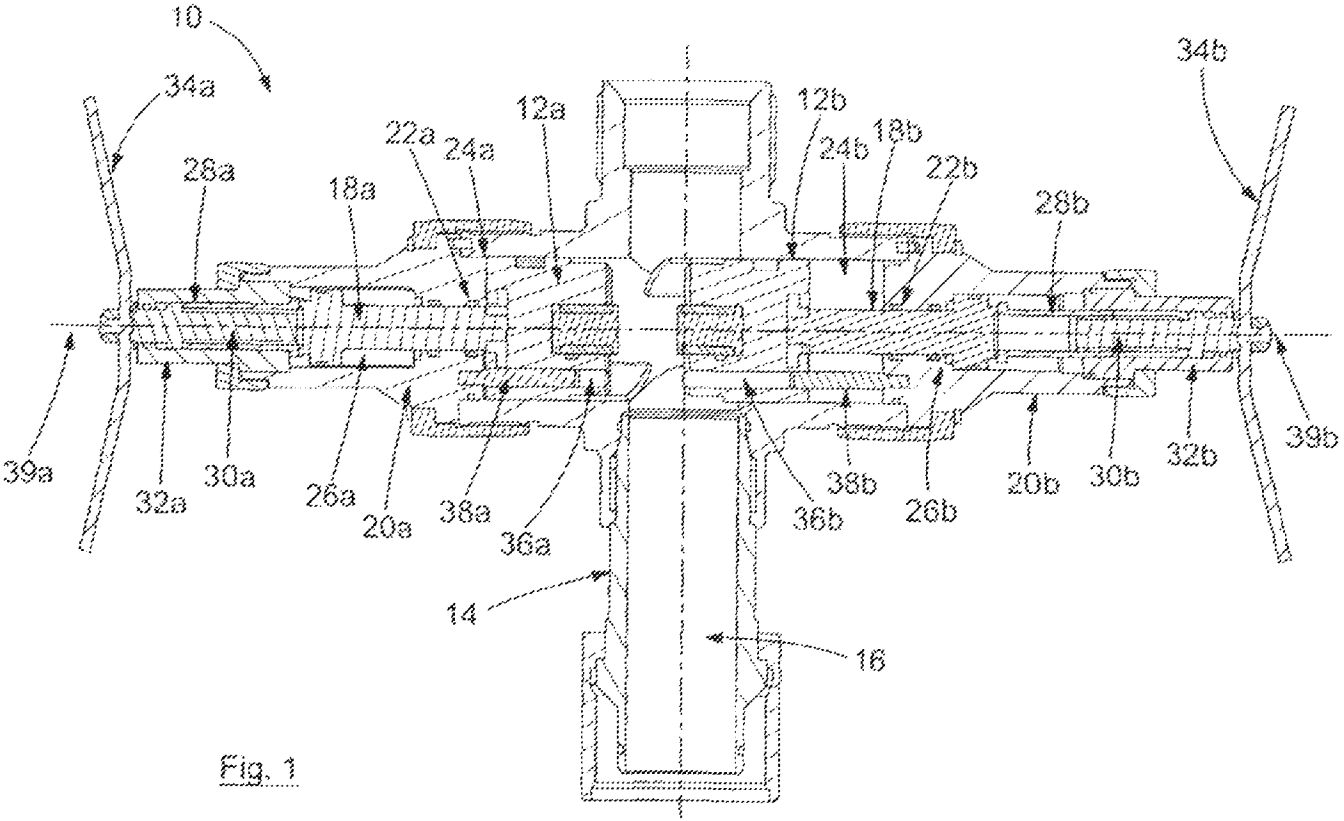
FIG. 1 is a sectional view of an existing wireline valve.

Reference is first made to FIG. 1 of the drawings, which is a sectional view of a conventional wireline valve, such as supplied by the applicant. The wireline valve 10 shown is a ram wireline valve comprising a pair of sealing heads 12*a*, 12*b* for sealing a wellbore 14 to restrict the passage of fluid 16 through the wellbore. The wireline valve 10 is shown in a partially closed configuration, with a first sealing head 12*a* in an open position and a second sealing head 12*b* in a closed position. Each sealing head 12*a*, 12*b* is attached to an activation rod 18*a*, 18*b*. A first activation rod 18*a* is shown in a retracted position, with the first sealing head 12*a* located proximal to a first rod housing 20*a*; whilst a second activation rod 18*b* is shown in an extended position, with the second sealing head 12*b* distal to a second rod housing 20*b*.

Annular activation rod seals 22*a*, 22*b* are located between the respective first and second activation rods 18*a*, 18*b* and their respective rod housing 20*a*, 20*b*. The annular activation rod seals 22*a*, 22*b* isolate sealing head chambers 24*a*, 24*b* from rod housing chambers 26*a*, 26*b* such that the sealing head chambers 24*a*, 24*b* are in fluid communication with the wellbore fluid 16 whilst the rod housing chambers 26*a*, 26*b* are isolated from the wellbore fluid 16 and therefore not subject to a wellbore fluid 16 pressure.

Each activation rod 18*a*, 18*b* is attached to a respective threaded sleeve 28*a*, 28*b*, which in turn is connected to a respective screw 30*a*, 30*b*. Each screw 30*a*, 30*b* is housed in a screw casing 32*a*, 32*b* such that the axial position of each screw 30*a*, 30*b* is fixed with respect to the bore 14. Each screw 30*a*, 30*b* is operable by a handle 34*a*, 34*b* such that each screw 30*a*, 30*b* rotates in the screw casing 32*a*, 32*b*. The screwthread interface between each screw 30*a*, 30*b* and the respective threaded sleeve 28*a*, 28*b* and a rotational restriction on each sleeve 28*a*, 28*b* results in axial movement of each sleeve 28*a*, 28*b* when the respective screw 30*a*, 30*b* is rotated. Axial movement of each sleeve 28*a*, 28*b* results in axial movement of the respective sealing head 12*a*, 12*b* such that the wellbore 14 can effectively be selectively opened or closed to the passage of fluid 16 through the wellbore 14.

Movement of an open sealing head 12*a* to the position of a closed sealing head 12*b* requires the displacement of a volume of fluid 16 in the wellbore corresponding to the additional volume of the rod 18*a*, 18*b* that enters the respective sealing head chamber 24*a*, 24*b*. The displacement of fluid 16 under wellbore pressure requires work. The pressure of the wellbore fluid 16 acting on the cross-sectional area of the rod 18*a*, 18*b* perpendicular to the direction of extension requires a force, which may be several tons depending on the particular wellbore pressure and the diameter of the rod 18*a*, 18*b*.

Each sealing head 12*a*, 12*b* comprises an aperture 36*a*, 36*b* for receiving a pin 38*a*, 38*b*; each pin 38*a*, 38*b* attached to the respective rod housing 20*a*, 20*b*. Each aperture 36*a*, 36*b* and corresponding pin 38*a*, 38*b* is offset from a central axis of extension 39*a*, 39*b* of each activation member 18*a*, 18*b* such that rotation of each sealing head 12*a*, 12*b* about each axis of extension 39*a*, 39*b* is prevented.

Reference is now made to FIGS. 2, 3, 4 and 5 of the drawings, which illustrate a part of a wireline valve 40 in accordance with an embodiment of the present invention. As will be described, the wireline valve 40 is configured to be moved between an open configuration and a closed configuration in a wellbore 42 by an activation stem 44 with an activation stem first end portion 46 and an activation stem second end portion 48 isolated from a bore fluid 50, such that a wellbore fluid 50 pressure does not act against the movement between the first and second configurations.

The illustrated wireline valve 40 comprises a sealing head 52 attached to a seal sleeve 54. The seal sleeve 54 is cylindrical and comprises a first and a second profiled portion 56*a*, 56*b* as can best be seen in FIG. 2. The two profiled portions 56*a*, 56*b* abut corresponding first and second sealing head profiled portions 58*a*, 58*b*. In the embodiment shown the profiled portion 56*a*, 56*b* is a flat portion. The profiled portions 56*a*, 56*b*, 58*a*, 58*b* ensure that the sealing head 52 cannot rotate relative to the seal sleeve 54, about a longitudinal axis 60.

The seal sleeve 54 is connected to the activation stem 44 by a set of keys 62*a*. The wireline valve 40 is configured to locate the seal sleeve 54 fully in the wellbore fluid 50 such that no static fluid pressure difference acts across the seal sleeve. The set of keys 62*a* are attached to the activation stem 44 at a central portion 64, which is positioned centrally in an intermediate portion 65 located between the activation stem first end portion 46 and the activation stem second end portion 48. In the embodiment shown the keys 62*a* have axial apertures, allowing the passage of fluid in a proximal chamber 66 that houses the seal sleeve 54.

In the embodiment shown, the central portion 64 comprises a shoulder joining two cylindrical portions of activation stem 44 of different diameters.

Figure 3:
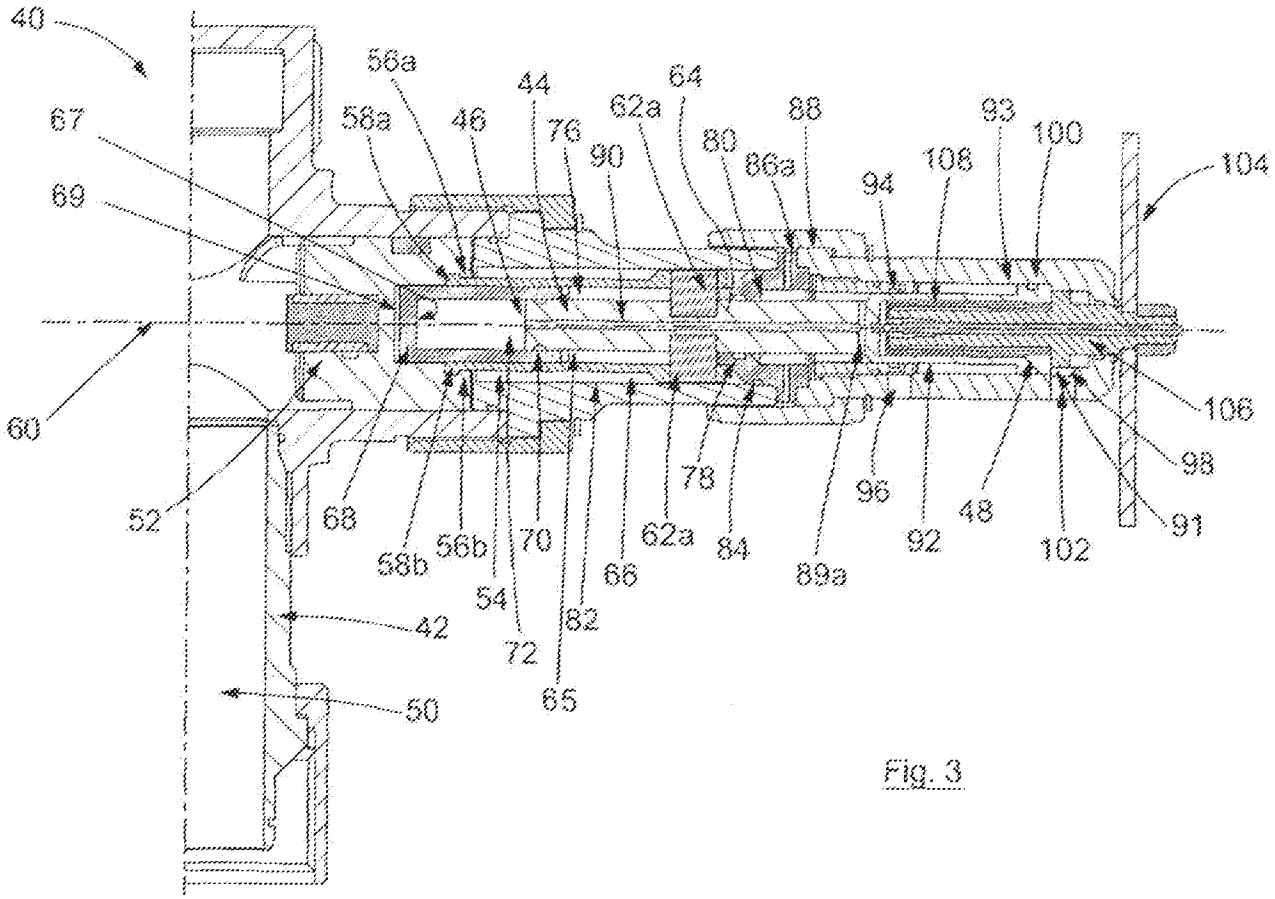
FIG. 3 is a sectional view of the part of a wireline valve of FIG. 2 showing the wireline valve in a first open configuration.

The activation stem 44 is received in an isolated first side 67 of a cylinder 68, with a cylinder seal 70 separating a cylinder chamber 72 from the proximal chamber 66 such that the cylinder chamber 72 is isolated from the wellbore fluid 50 pressure. A second side 69 of the cylinder 68 is exposed to wellbore fluid 50. The activation stem first end portion 46 is located in the proximal chamber 66 in the open configuration as shown in FIG. 3 and also located in the proximal chamber 66 in the closed configurations of FIGS. 4 and 5. The activation stem first end portion 46 is thus always separated from the wellbore fluid 50 by the cylinder seal 70 such that the activation stem first end portion 46 is never exposed to the wellbore fluid 50 pressure.

Figure 4:
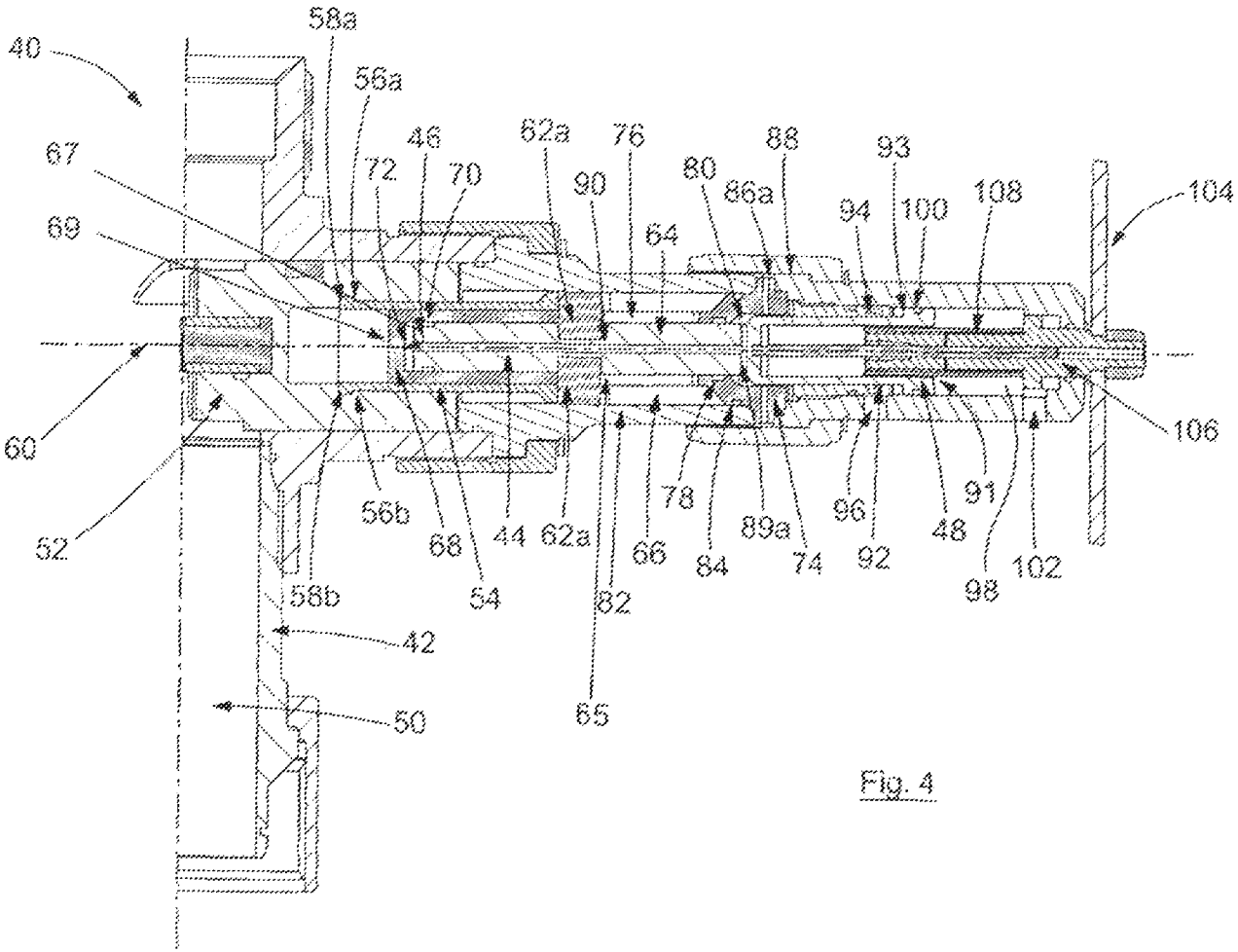
FIG. 4 is a sectional view of the part of a wireline valve of FIG. 2 showing the wireline valve in a first closed configuration.
Figure 5:
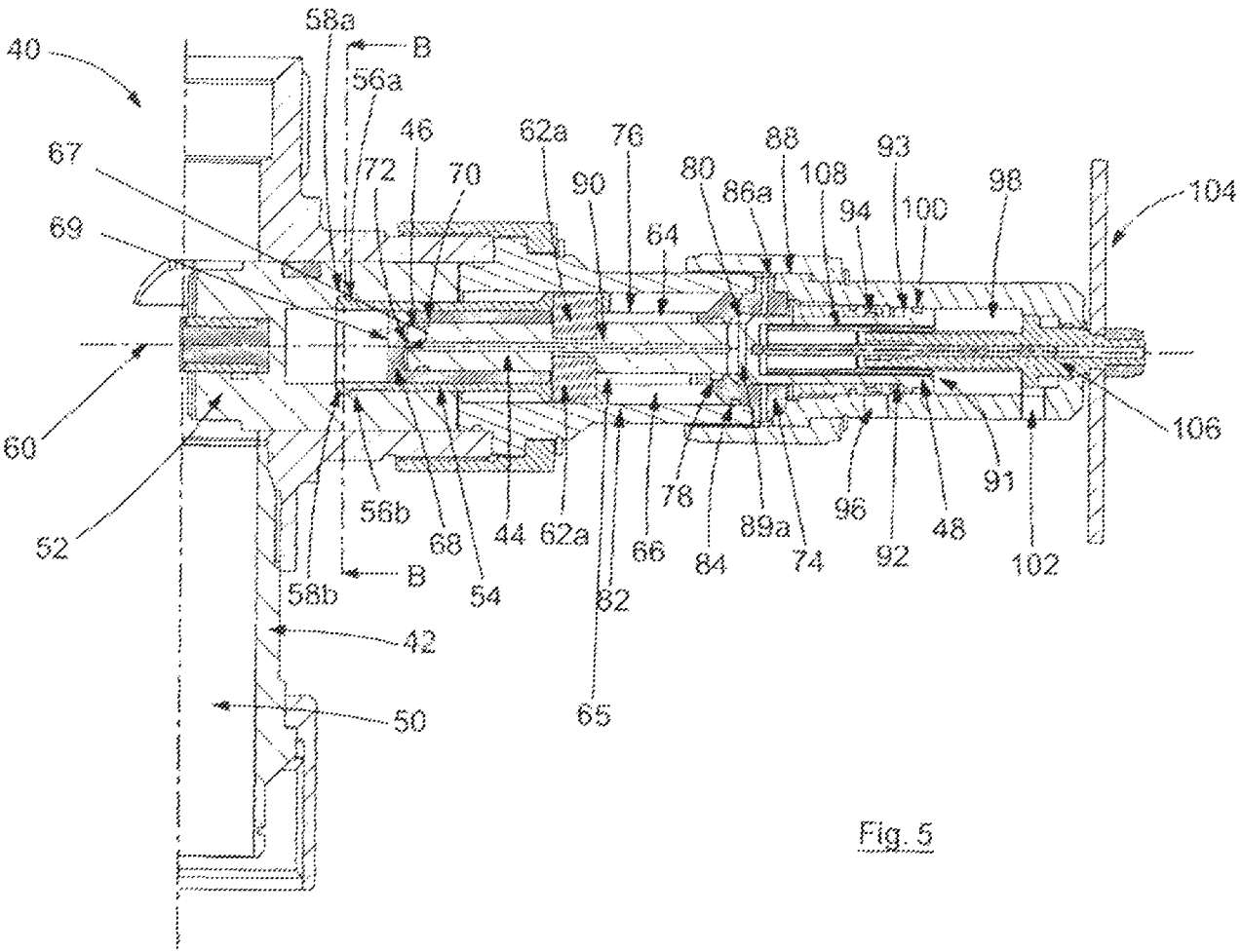
FIG. 5 is a sectional view of the part of a wireline valve of FIG. 2 showing the wireline valve in a second closed configuration.

The cylinder 68 is connected to an activation stem housing 74 via supports comprising axial slots 76 to allow the passage of the keys 62*a* from the first configuration of FIG. 3 to the second configurations of FIGS. 4 and 5. The activation stem housing 74 comprises an activation stem seal 78 separating an intermediate chamber 80 from the proximal chamber 66 such that the intermediate chamber 80 is isolated from the wellbore fluid 50 pressure. The activation stem second end portion 48 is also separated from the proximal chamber 66 by the activation stem seal 78, such that the activation stem second end portion 48 is isolated from the wellbore fluid 50 pressure. The activation stem second end portion 48 is thus always separated from the wellbore fluid 50 by the activation stem seal 78 such that the activation stem second end portion 48 is never exposed to the wellbore fluid 50 pressure, either in the positions of the open configuration as shown in FIG. 3 or the closed configurations of FIGS. 4 and 5, or positions therebetween.

In the embodiment shown, the diameter of the activation stem 44 at the cylinder seal 70 is less than the diameter of the activation stem 44 at the activation stem seal 78 in both the open and the closed configurations. The central portion 64 comprises a transition from a first end portion 46 diameter to a second end portion 48 diameter, such that the cylinder seal 70 receives a first cylindrical portion of activation stem 44 of lesser diameter than a second cylindrical portion received by the activation stem seal 78.

In the embodiment shown, the activation stem housing 74 is attached to a wireline valve casing 82 with a housing seal 84 preventing the passage of the wellbore fluid 50 in the annulus between the housing 74 and the casing 82. The housing 74 further comprises vents 86*a* fluidly connecting the cylinder chamber 72 through an annular passage 88 to the exterior of the casing 82, via the intermediate chamber 80, radial passages 89*a* and an axial passage 90 in the activation stem 74.

The intermediate chamber 80 is separated from a retraction chamber 92 via an intermediate seal 94. The retraction chamber 92 is connected via a retraction port 96 to a first hydraulic source. The retraction chamber 92 is separated from an extension chamber 98 by a hydraulic seal 100. The extension chamber 98 is connected to a second hydraulic source via an extension port 102.

In the open configuration of FIG. 3, the activation stem 44 is in a retracted position. To move the wireline valve 40 from the open configuration of FIG. 3 to the closed configuration of FIG. 4, pressure is applied to the extension chamber 98 by the supply of hydraulic fluid through the extension port 102, such that a pressure is applied on an outer axial surface 91 of the second end portion 48 of the activation stem 44. The axial force acting inwardly on the second end portion 48 exceeds the axial force acting outwardly on the first end portion 46 and frictional resistances such that the activation stem 44 moves towards the bore 42. To move the wireline valve 40 from the closed configuration of FIG. 4 to the open configuration of FIG. 3, pressure is applied to the retraction chamber 92 by the supply of hydraulic fluid through the retraction port 96, such that a pressure is applied on an inner axial surface 93 of the second end portion 48 of the activation stem 44. Hydraulic fluid is also extracted from the extension chamber 98 through the extension port 102.

Figure 2:
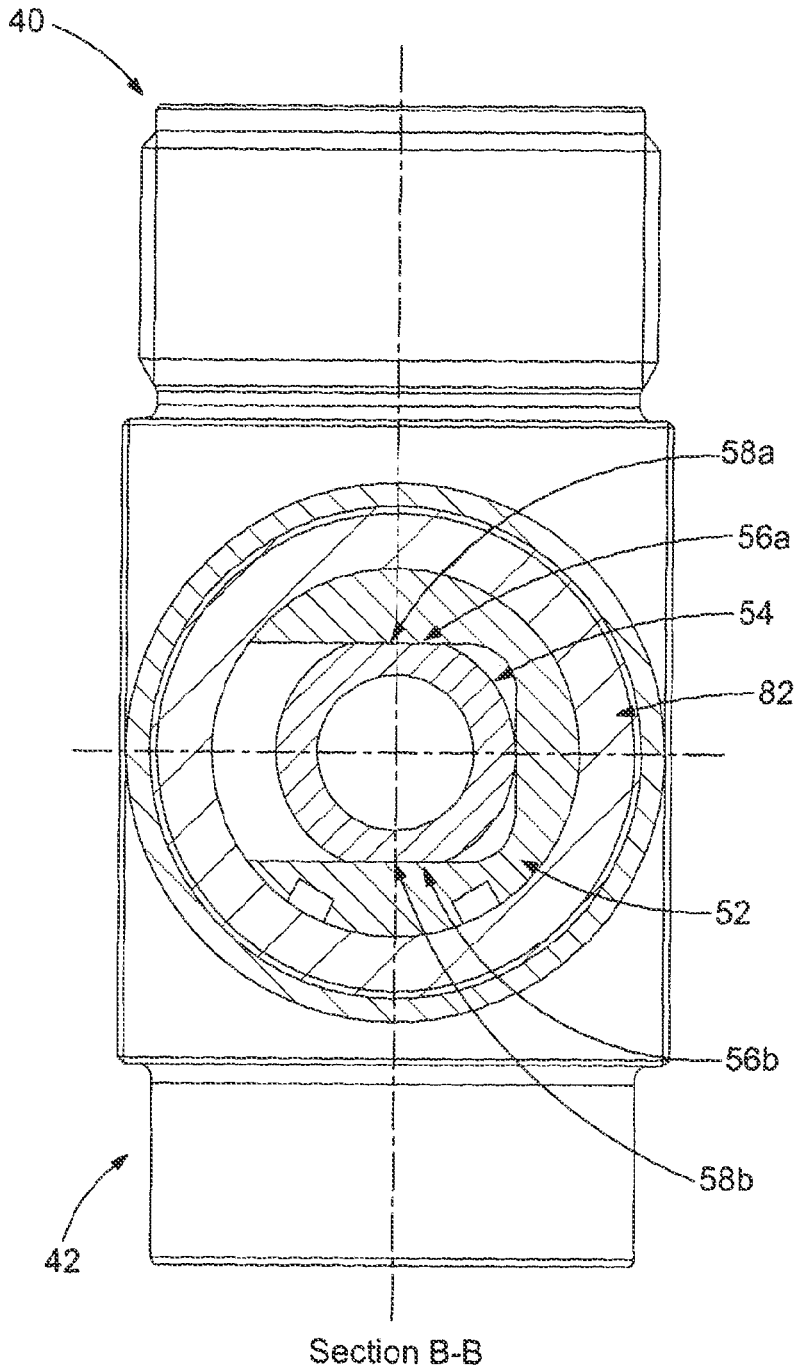
FIG. 2 is a sectional view of a part of a wireline valve in accordance with an embodiment of the present invention, the sectional view corresponding to line B-B of FIG. 5.

FIG. 5 shows an alternative closed configuration of the wireline valve 40 of FIG. 2. To move the activation stem 44 from the open position of FIG. 3 to the closed position of FIG. 5, mechanical force is applied to the second end portion 48 by rotating a handle 104. Rotation of the handle 104 causes a screw 106 to rotate, the axial position of the screw 106 relative to the bore 42 being restricted by the casing 82 such that the screw 106 maintains the same axial position during rotation. The screw 106 is connected by screwthread to a threaded sleeve 108, the rotational movement of the threaded sleeve restricted by the activation stem 44 such that rotation of the screw 106 results in axial movement of the threaded sleeve 108. The axial movement of the threaded sleeve 108 thus causes axial movement of the activation stem 44 such that the wireline valve 40 is moved to the closed configuration of FIG. 5. Mechanical movement of the activation stem 44 by the handle 104 may be aided by a pressure in the activation chamber 98.

The closed configuration of FIG. 5 may also be used subsequent to the configuration of FIG. 4. For example, hydraulic fluid may be used to rapidly move the valve 40 to the closed configuration and thereafter the screw 106 may be rotated to position the threaded sleeve 108 to act as a mechanical lock to prevent movement of the valve 40 to the first configuration under wellbore fluid pressure. Supply of hydraulic fluid to the extension chamber 98 may be stopped, the sleeve 108 maintaining the valve in the closed configuration of FIG. 5. In the embodiment shown, as the diameter of the activation stem seal 78 is greater than the diameter of the cylinder seal 70, rotating the screw 106 in an opposite direction to return the threaded sleeve 108 to the position of FIG. 4 is sufficient to move the valve 40 to the open configuration of FIG. 3; provided that there is no significant pressure difference between the extension 98 and retraction 92 chambers.

FIG. 5 further shows the section line B-B indicating the sectional view depicted in FIG. 2.

In an alternative embodiment the retraction port may be connected to the cylinder chamber 72. For example, where there is no intermediate chamber 80 and the axial passage 90 extends to the retraction chamber.

It will be apparent to those of skill in the art that the above described embodiment is merely exemplary of the present invention, and that various modifications and improvements may be made thereto, without departing from the scope of the invention.

The invention claimed is:

1. A wellbore valve for sealing off a wellbore by preventing a flow of a fluid through a bore passage, the wellbore valve comprising:

a bore sealing member for sealing off the passage of said fluid through the bore passage; and an actuation assembly for moving the bore sealing member between a first configuration corresponding to a bore passage open configuration and a second configuration corresponding to a bore passage closed configuration, the actuation assembly comprising an activation member with a first end portion and a second end portion, wherein the actuation assembly is configured to isolate the first and second end portions of the activation member from said fluid in the bore passage in both the first and second configurations;

wherein the wellbore valve displaces substantially the same volume of said fluid in the bore passage in the first configuration and in the second configuration;

wherein the first end portion is isolated from said fluid by the receipt of said first end portion within a chamber of a cylinder, said chamber being sealed from said fluid by a cylinder seal;

wherein the second end portion is isolated from said fluid by receipt of said second end portion in a second chamber, said second chamber being sealed from said fluid by a second end portion seal; and wherein the actuation assembly is configured to move the activation member in a direction substantially perpendicular to the wellbore.

2. A wellbore valve according to claim 1, wherein the wellbore valve is configured to expose an intermediate portion of the activation member to bore fluid in the first and/or second configuration/s, the intermediate portion being located between the first and second end portions of the activation member.

3. A wellbore valve according to claim 1, wherein the first end portion of the activation member is configured to be proximal to the bore passage in the first configuration and the second end portion of the activation member is configured to be distal to the bore passage in the first configuration.

4. A wellbore valve according to claim 1, wherein the actuation assembly is configured to move the activation member in a direction substantially perpendicular to the bore passage.

5. A wellbore valve according to claim 1, wherein the actuation assembly further comprises an isolator comprising a first side configured for receiving the first end portion of the activation member.

6. A wellbore valve according to claim 5, wherein the isolator is configured to maintain substantially the same position relative to the bore during movement of the activation member from a first position to a second position, the first position corresponding to the first configuration and the second position corresponding to the second configuration.

7. A wellbore valve according to claim 1, wherein the first end portion and the second end portion are isolated such that the first end portion and second end portions are subjected to different fluid pressures.

8. A wellbore valve according to claim 1, wherein the activation member further comprises a bore sealing member interface located between the first end portion and the second end portion of the activation member.

9. A wellbore valve according to claim 1, wherein the wellbore valve is configured to be hydraulically activated.

10. A wellbore valve according to claim 1, wherein the wellbore valve comprises a mechanical actuator.

11. A wellbore valve according to claim 10, wherein the mechanical actuator locks the wellbore valve in the second configuration.

12. A wellbore valve according to claim 1, wherein the actuation assembly is configured to prevent rotation of the activation member about the axis parallel to the direction of extension of the activation member for moving the bore sealing member.

13. A wellbore valve according to claim 1, wherein the wellbore valve comprises a wireline valve.

14. The wellbore valve of claim 13, wherein the wellbore valve is a ram wireline valve comprising a pair of bore sealing members, each bore sealing member being associated with a respective actuation assembly for moving each bore sealing member between the first configuration corresponding to the bore passage open configuration and the second configuration corresponding to the bore passage closed configuration, the pair of bore sealing members being opposably-mounted to move transverse towards each other to seal the wellbore.

15. A wellbore valve according to claim 1, wherein the wellbore valve comprises a BOP.

16. A wellbore valve according to claim 1, wherein the wellbore valve comprises a gate valve.

17. A wellbore valve according to claim 1, wherein the wellbore valve is configured to expose only an intermediate portion of the activation member to the bore fluid pressure, the intermediate portion located between the first and second end portions.

18. A wellbore valve for sealing off a wellbore by preventing a flow of a fluid through a bore passage, the wellbore valve comprising:

a bore sealing member for sealing off the passage of said fluid through the bore passage; and n actuation assembly for moving the bore sealing member between a first configuration corresponding to a bore passage open configuration and a second configuration corresponding to a bore passage closed configuration, the actuation assembly comprising an activation member with a first end portion and a second end portion, wherein the actuation assembly is configured to isolate the first and second end portions of the activation member from said fluid in the bore passage in both the first and second configurations; and an isolator comprising a first side configured for receiving the first end portion of the activation member;

wherein the wellbore valve displaces substantially the same volume of said fluid in the bore passage in the first configuration and in the second configuration; and wherein the actuation assembly is configured to separate the isolator first side from the bore fluid and to position the isolator second side in fluid communication with the bore fluid; and wherein the actuation assembly is configured to move the activation member in a direction substantially perpendicular to the wellbore.

19. A wellbore valve according to claim 1, wherein the actuation assembly further comprises a first end portion seal, the first end portion seal located between the first end portion and the second end portion, and the first end portion seal configured to prevent the first end portion contacting the bore fluid.

20. A wellbore valve according to claim 19, wherein the actuation assembly further comprises a second end portion seal for sealing the second end portion, the second end portion seal located between the second end portion and the first end portion, and the second end portion seal configured to prevent the second end portion contacting the bore fluid.

21. A wellbore valve according to claim 20, wherein the first end portion seal is configured to seal a first cross-sectional area of the activation member perpendicular to a direction of extension for moving the bore sealing member from the first configuration to the second configuration.

22. A wellbore valve according to claim 21, wherein the second end portion seal is configured to seal a second cross-sectional area of the activation member perpendicular to a direction of extension for moving the bore sealing member from the first configuration to the second configuration.

23. A wellbore valve according to claim 22, wherein the first and the second cross-sectional areas are substantially the same.

24. A method of sealing off a wellbore by preventing a flow of a fluid in a bore passage, the method comprising:

moving a bore sealing member of a wellbore valve from a first configuration corresponding to a bore passage open configuration, to a second configuration corresponding to a bore passage closed configuration, by moving an activation member of the wellbore valve from a first position to a second position, the activation member comprising a first end portion and a second end portion, wherein the activation member is moved from the first position to the second position with the first end portion and the second end portion isolated from said fluid in the bore passage, such that the wellbore valve displaces substantially the same volume of said fluid in the bore passage in the first configuration and in the second configuration;

wherein the first end portion is isolated from said fluid by the receipt of said first end portion within a chamber of a cylinder, said chamber being sealed from said fluid by a cylinder seal;

wherein the second end portion is isolated from said fluid by receipt of said second end portion in a second chamber, said second chamber being sealed from said fluid by a second end portion seal; and wherein the actuation assembly is configured to move the activation member in a direction substantially perpendicular to the wellbore.

25. A method according to claim 24, wherein the method comprises exposing an intermediate portion of the activation member to said bore fluid in the first and/or second configuration/s.

26. A wellbore valve for sealing off a wellbore by preventing a flow of a fluid through a wellbore passage, the wellbore valve comprising:

a bore sealing member for sealing off the flow of said fluid through the wellbore passage; and an actuation assembly including an activation member;

wherein the bore sealing member is connected to the actuation assembly by a profiled head attached to a seal sleeve, the profiled head being rotationally asymmetrical about a central longitudinal axis of the bore sealing member, wherein the seal sleeve is substantially cylindrical but comprises a first and a second profiled seal sleeve portion that abut corresponding first and second sealing head profiled portions and a first end portion of the activation member is isolated from said fluid within the wellbore passage by a cylinder chamber receiving the first end portion, said cylinder chamber being sealed from said fluid by a cylinder seal;

wherein the actuation assembly is configured to move the activation member in a direction substantially perpendicular to the wellbore; and wherein the wellbore valve displaces substantially the same volume of said fluid in the bore passage in an open configuration and in a closed configuration.

27. The wellbore valve of claim 26, wherein the profiled seal sleeve portions comprise a flat portion, the flat portion being parallel to the longitudinal axis of the bore sealing member.

* * * * *